US010775012B2

(12) United States Patent
Groetsch et al.

(10) Patent No.: US 10,775,012 B2
(45) Date of Patent: Sep. 15, 2020

(54) PIXEL LIGHT SOURCE

(71) Applicant: OSRAM OLED GmbH, Regensburg (DE)

(72) Inventors: Stefan Groetsch, Bad Abbach (DE); Julia Rothneichner, Regensburg (DE)

(73) Assignee: OSRAM OLED GmbH, Regensburg (DE)

( * ) Notice: Subject to any disclaimer, the term of this patent is extended or adjusted under 35 U.S.C. 154(b) by 1 day.

(21) Appl. No.: 16/080,868

(22) PCT Filed: Mar. 2, 2017

(86) PCT No.: PCT/EP2017/054922
§ 371 (c)(1),
(2) Date: Aug. 29, 2018

(87) PCT Pub. No.: WO2017/149080
PCT Pub. Date: Sep. 8, 2017

(65) Prior Publication Data

US 2019/0049083 A1 Feb. 14, 2019

(30) Foreign Application Priority Data

Mar. 2, 2016 (DE) ..... 10 2016 103 717

(51) Int. Cl.
*F21S 41/16* (2018.01)
*F21S 41/14* (2018.01)
(Continued)

(52) U.S. Cl.
CPC ..... *F21S 41/16* (2018.01); *F21K 9/64* (2016.08); *F21S 41/14* (2018.01); *F21S 41/18* (2018.01);
(Continued)

(58) Field of Classification Search
CPC .. F21S 41/16; F21S 41/14; F21S 41/18; F21S 41/645; F21S 41/675; F21S 41/285; F21S 41/176; F21K 9/64; F21Y 2115/30
(Continued)

(56) References Cited

U.S. PATENT DOCUMENTS

2005/0174771 A1* 8/2005 Conner ..... G02B 27/0961 362/244
2006/0039140 A1 2/2006 Magarill
(Continued)

FOREIGN PATENT DOCUMENTS

DE 10 2013 020 549 A1 6/2015
DE 102016216616 A1 * 3/2018 ..... F21S 41/143
(Continued)

OTHER PUBLICATIONS

Vikrant R. Bhakta et al., "High resolution adaptive headlight using Texas Instruments DLP® technology," ISAL 2015 Proceedings, pp. 483-494.

*Primary Examiner* — Cara E Rakowski
*Assistant Examiner* — Jessica M Apenteng
(74) *Attorney, Agent, or Firm* — DLA Piper LLP (US)

(57) ABSTRACT

A pixel light source includes having a light source array, an optical system and an imager matrix arrangement, wherein the optical system maps light radiated by the light source array onto the imager matrix arrangement, the light source array includes a plurality of light emitting diode elements and a plurality of LARP elements, and the optical system is configured to map the light radiated by at least one of the LARP elements into a gap in the angular aperture situated between the light radiated by the light emitting diode elements.

11 Claims, 3 Drawing Sheets

(51) Int. Cl.
*F21S 41/64* (2018.01)
*F21K 9/64* (2016.01)
*F21Y 115/30* (2016.01)

(52) U.S. Cl.
CPC ..... *F21S 41/645* (2018.01); *F21Y 2115/30* (2016.08)

(58) Field of Classification Search
USPC ..... 362/459
See application file for complete search history.

(56) References Cited

U.S. PATENT DOCUMENTS

| | | | |
|---|---|---|---|
| 2015/0160454 | A1 | 6/2015 | Bhakta |
| 2015/0377446 | A1 | 12/2015 | Bhakta |

FOREIGN PATENT DOCUMENTS

| | | | | | |
|---|---|---|---|---|---|
| DE | 102016216624 | A1 * | 3/2018 | ..... | F21S 41/153 |
| DE | 102017101001 | A1 * | 7/2018 | ..... | F21S 41/24 |
| WO | 2011/156271 | A2 | 12/2011 | | |

* cited by examiner

PIXEL LIGHT SOURCE

TECHNICAL FIELD

This disclosure relates to a pixel light source.

BACKGROUND

Pixel light sources comprising micromirror matrix arrangements for light shaping are known. Such pixel light sources can be used as headlamps for motor vehicles, for example, as described in Vikrant R. Bhakta et al., "High resolution adaptive headlight using Texas Instruments DLP® technology," ISAL 2015, page 483. WO 2011/156271 A3 describes a pixel light source having a light source array in a sparse arrangement.

SUMMARY

We provide a pixel light source including having a light source array, an optical system and an imager matrix arrangement, wherein the optical system maps light radiated by the light source array onto the imager matrix arrangement, the light source array includes a plurality of light emitting diode elements and a plurality of LARP elements, and the optical system is configured to map the light radiated by at least one of the LARP elements into a gap in the angular aperture situated between the light radiated by the light emitting diode elements.

We also provide a headlamp for a motor vehicle including having a light source array, an optical system and an imager matrix arrangement, wherein the optical system maps light radiated by the light source array onto the imager matrix arrangement, the light source array includes a plurality of light emitting diode elements and a plurality of LARP elements, and the optical system is configured to map the light radiated by at least one of the LARP elements into a gap in the angular aperture situated between the light radiated by the light emitting diode elements.

LIST OF REFERENCE SIGNS

Figure 1:
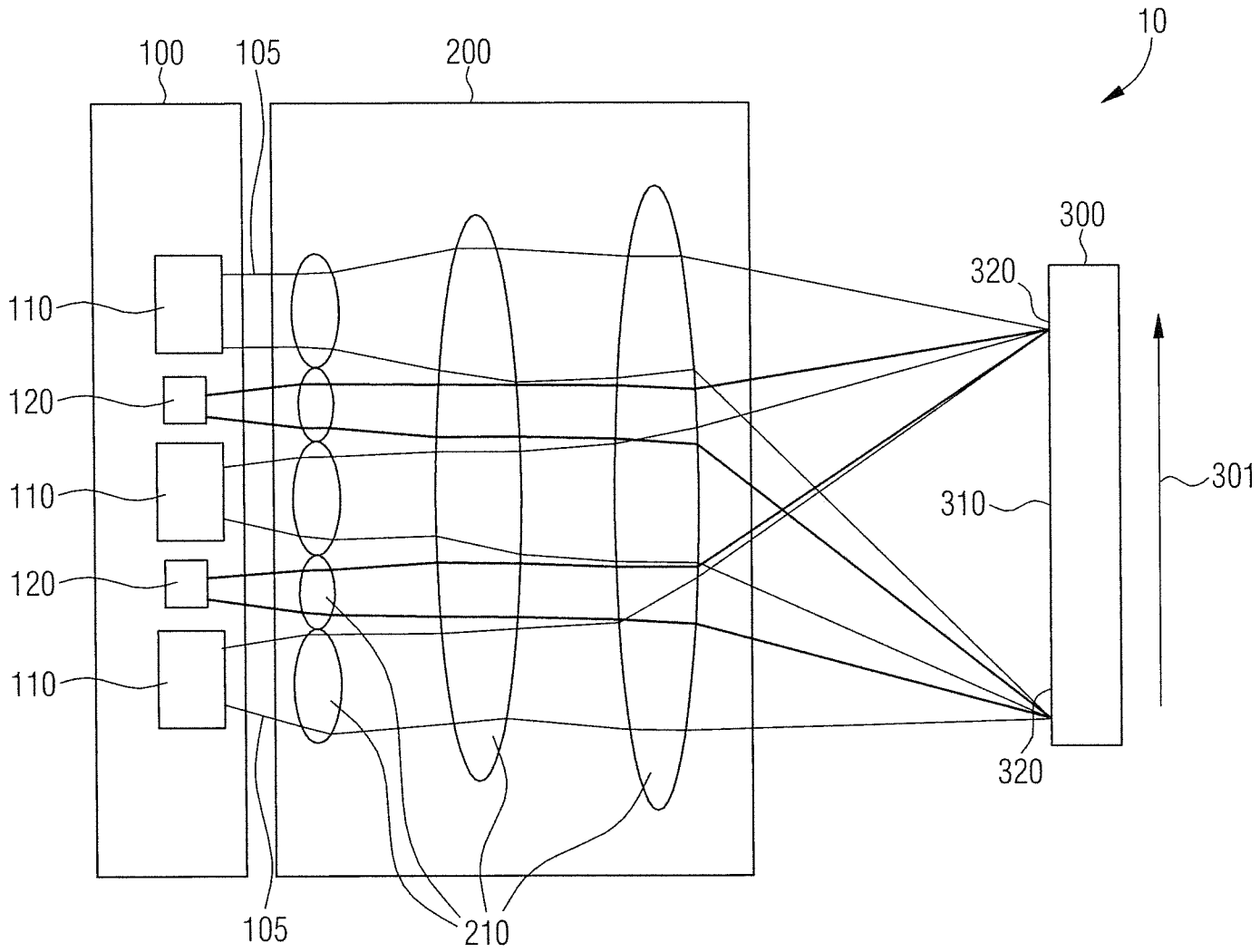
FIG. 1 schematically shows a plan view of a pixel light source with a light source array, an optical system and an imager matrix arrangement.

10 pixel light source
100 light source array
105 light
110 light emitting diode element
115 hexagonal pattern
120 LARP element
125 hexagonal pattern
200 optical system
210 optical lens
300 imager matrix arrangement
301 first direction

302 second direction
310 middle
320 edge region
400 intensity distribution
401 intensity
410 intensity of a light emitting diode element
420 intensity of an LARP element
430 total intensity
500 angular aperture
510 first extent of the angular aperture
520 second extent of the angular aperture
530 angle covered by light emitting diode element
540 angle covered by LARP element
550 gap

DETAILED DESCRIPTION

Our pixel light source comprises a light source array, an optical system and an imager matrix arrangement. In this case, the optical system is intended to map light radiated by the light source array onto the imager matrix arrangement. The light source array has a plurality of light emitting diode elements and a plurality of LARP elements.

The LARP elements (LARP stands for laser activated remote phosphor) each have a wavelength-converting element and a semiconductor laser diode that illuminates the wavelength-converting element. The wavelength-converting element converts irradiated laser light into useful light of a different wavelength.

The light emitting diode elements of the light source array of the pixel light source may advantageously be available at low cost and allow production of a high total light current by the light source array. The LARP elements can advantageously additionally produce a high illuminance maximum in the center of the region illuminated by the pixel light source. As a result, the pixel light source is advantageously appropriate in particular for applications that require inhomogeneous illumination of a region illuminated by the pixel light source.

The LARP elements may be arranged between the light emitting diode elements. Advantageously, this results in a compact and space-saving configuration of the light source array of the pixel light source.

The light emitting diode elements may be arranged in a hexagonal pattern. Advantageously, the light emitting diode elements in such an arrangement allow uniform illumination even when the individual light emitting diode elements are arranged at a distance from one another.

The LARP elements may be arranged in a hexagonal pattern. Advantageously, this arrangement of the LARP elements allows particularly simple and uniform arrangement of the LARP elements between the light emitting diode elements of the light source array.

The hexagonal pattern of the light emitting diode elements and the hexagonal pattern of the LARP elements may overlap. Advantageously, the LARP elements and the light emitting diode elements in this arrangement are particularly uniformly distributed over the surface area of the light source array. In another configuration, the LARP elements and the light emitting diode elements may be arranged separately from one another.

The optical system may map the light radiated by the light source array onto the imager matrix arrangement with a first extent, measured in a first direction, of the angular aperture and a second extent, measured in a second direction, of the angular aperture. In this case, the first direction and the second direction are oriented at right angles to one another.

Moreover, the first extent of the angular aperture and the second extent of the angular aperture are of different magnitude. Advantageously, the optical system of the pixel light source is thereby adapted to the imager matrix arrangement of the pixel light source being able to comprise different angular aperture magnitudes in different spatial directions. As a result, the optical system allows optimum utilization of the angular aperture of the imager matrix arrangement of the pixel light source. A larger range can be modulated and therefore more modulated light can be transmitted in total.

The optical system may be configured to map the light radiated by at least one of the LARP elements into a gap in the angular aperture situated between the light radiated by the light emitting diode elements. Advantageously, this allows gaps in the angular aperture that arise as a result of the individual light emitting diode elements of the light source array being arranged at a distance from one another to be filled at least in part by the LARP elements. Another option is for individual positions in the angular aperture illuminated by light emitting diode elements of the light source array to be additionally illuminated by LARP elements.

At least one LARP element may be configured such that light radiated by the LARP element and mapped onto the imager matrix arrangement by the optical system comprises an intensity that falls from the middle of the imager matrix arrangement to an edge region of the imager matrix arrangement. Advantageously, the pixel light source thereby allows a target region to be illuminated with a luminance higher in the central region than in outer regions. This is advantageous for many illumination applications in which a middle region of the illuminated region is of particular interest. Advantageously, the design of the pixel light source exploits the circumstance that LARP elements, based on a design, comprise spatially inhomogeneous radiation characteristics.

The optical system may comprise a plurality of optical lenses. As a result, the optical system can allow the light radiated by each of the light emitting diode elements of the plurality of light emitting diode elements of the light source array and the light radiated by each of the LARP elements of the plurality of LARP elements of the light source array to be mapped onto the imager matrix arrangement of the pixel light source. The optical system can comprise a field lens.

The imager matrix arrangement may be configured as a micromirror matrix arrangement. A particular advantage of the pixel light source in this case is that different angular aperture magnitudes of the micromirror matrix arrangement in different spatial directions can be exploited in optimum fashion by the pixel light source.

The pixel light source may be configured as a headlamp for a motor vehicle. In this case, it is a particular advantage that the pixel light source can illuminate a middle region of the region illuminated by the pixel light source with higher luminance than an edge region.

The properties, features and advantages described above and the way in which they are achieved will become clearer and more distinctly comprehensible in connection with the description of examples that follow, these being explained in more detail in connection with the drawings, in schematic form.

FIG. 1 shows a highly schematized depiction of a pixel light source 10. The pixel light source 10 may be configured as a headlamp for a motor vehicle, for example, or can form part of a headlamp of a motor vehicle. In particular, the pixel light source 10 may be configured as a front headlamp, for example.

The pixel light source 10 comprises a light source array 100, an optical system 200 and an imager matrix arrangement 300.

The light source array 100 radiates light 105. The light 105 is normally light from the visible spectral range, for example, white light.

The optical system 200 maps the light 105 radiated by the light source array 100 onto the imager matrix arrangement 300.

The imager matrix arrangement 300 in the example depicted is configured as a micromirror matrix arrangement (Digital Micromirror Device DMD) having a multiplicity of individually tiltable micromirrors arranged in a matrix arrangement. The imager matrix arrangement 300 can alternatively also be configured as a microshutter matrix arrangement (Digital Micro Shutter DMS or MEMS Shutter), as a transmissive liquid crystal display (LCD) or as a reflective liquid crystal display (Liquid Crystal on Silicon LCoS), however.

The imager matrix arrangement 300 shapes the light 105 mapped onto the imager matrix arrangement 300 by the optical system 200 and deflects it into a region to be illuminated by the pixel light source 10 in the surroundings of the pixel light source 10. To this end, the pixel light source 10 can have a further optical system arranged between the imager matrix arrangement 300 and the region to be illuminated by the pixel light source 10. This further optical system is not shown in the schematic depiction of FIG. 1 and can also be dispensed with.

Figure 2:
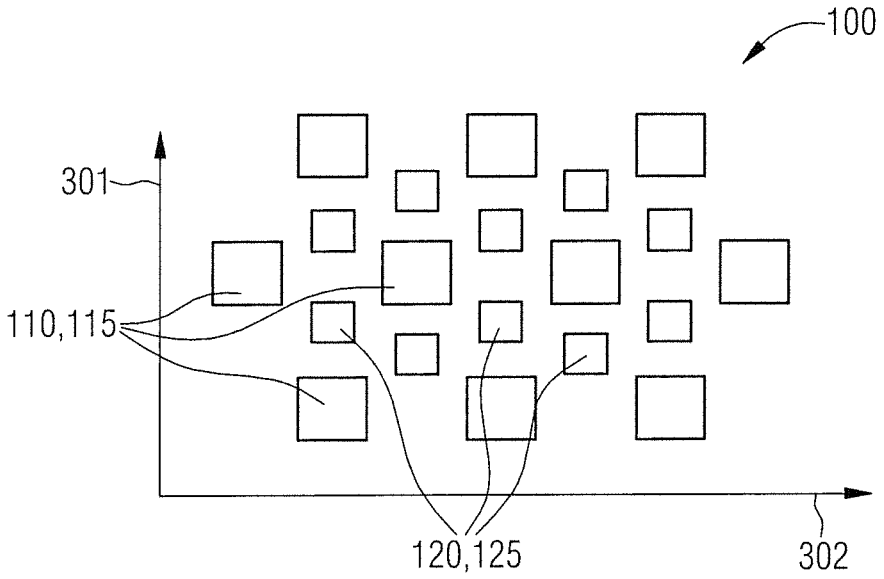
FIG. 2 schematically shows a plan view of the light source array of the pixel light source.

FIG. 2 shows a schematic depiction of a plan view of the radiation side of the light source array 100 of the pixel light source 10. The line of vision in FIG. 2 is opposite to the direction of radiation of the light 105 radiated by the light source array 100.

The light source array 100 has a plurality of light emitting diode elements 110 and a plurality of LARP elements 120.

The light emitting diode elements 110 each have one or more light emitting diode chips and can each also have a converter element that converts light emitted by the respective light emitting diode chip into useful light of a different wavelength, for example, into white light.

The abbreviation LARP stands for laser activated remote phosphor, that is to say for a converter element spot lit by a laser chip, which converter element is arranged at a distance from the laser chip. The LARP elements can also be referred to as elements that produce useful light by a converter element illuminated by a laser. The LARP elements each have a laser chip and a wavelength-converting element. The laser chip illuminates the wavelength-converting element with a laser beam. The wavelength-converting element converts at least some of the light of the laser beam into useful light of a different wavelength. By way of example, into yellow light, to produce white light in the mix with unconverted light.

The light emitting diode elements 110 of the light source array 100 of the pixel light source 10 are arranged at a distance from one another in what is known as a sparse arrangement. In this case, the light emitting diode elements 110 in the example shown in FIG. 2 are arranged in a hexagonal pattern 115. In the example shown in FIG. 2, the light source array 100 has ten light emitting diode elements 110. The light source array 100 can also be configured with a different number of light emitting diode elements 110, however, in particular with a higher number of light emitting diode elements 10.

The LARP elements 120 of the light source array 100 of the pixel light source 10 are arranged at a distance from one another between the light emitting diode elements 110 of the light source array 100. In the example shown in FIG. 2, the light source array 100 of the pixel light source 10 has ten LARP elements 120. The number of LARP elements 120 can also be different, however, in particular greater. The number of LARP elements 120 of the light source array 100 may be consistent with the number of light emitting diode elements 110, this not being absolutely necessary, however.

In the example shown in FIG. 2, the LARP elements 120 are arranged in a hexagonal pattern 125. In this case, the hexagonal pattern 125 of the LARP elements 120 and the hexagonal pattern 115 of the light emitting diode elements 110 overlap such that the LARP elements 120 are arranged between the light emitting diode elements 110.

In the example of the light source array 100 shown in FIG. 2, the light emitting diode elements 110 and the LARP elements 120 of the light source array 100 are arranged such that the radiation side of the light source array 100 comprises a narrower width in a first direction 301 than in a second direction 302 at right angles to the first direction 301. This is not absolutely necessary, however. The light source array 100 can also be configured such that it comprises substantially the same width in both the first direction 301 and the second direction 302.

The optical system 200 visible in the schematic depiction of the pixel light source 10 of FIG. 1 maps the light 105 radiated by the light source array 100 onto the imager matrix arrangement 300. To this end, the optical system 200 has a plurality of optical lenses 210. One or more of the optical lenses 210 of the optical system 200, in particular the last optical lens 210 of the optical system 200, may be field lenses. The optical system 200 can comprise optical lenses 210 individually associated with the individual light emitting diode elements 110 and LARP elements 120 of the light source array 100. In this case, each light emitting diode element 110 and each LARP element 120 of the light source array 100 may each have one or more associated optical lens(es) 210 of their own.

The optical system 200 maps the light 105 emitted by the light source array 100 onto the imager matrix arrangement 300 such that each portion of the light 105 radiated by a light emitting diode element 110 or an LARP element 120 is respectively mapped onto the entire surface area of the imager matrix arrangement 300. Those portions of the light 105 radiated by the individual light emitting diode elements 110 and LARP elements 120 overlap at the imager matrix arrangement 300.

Figure 3:
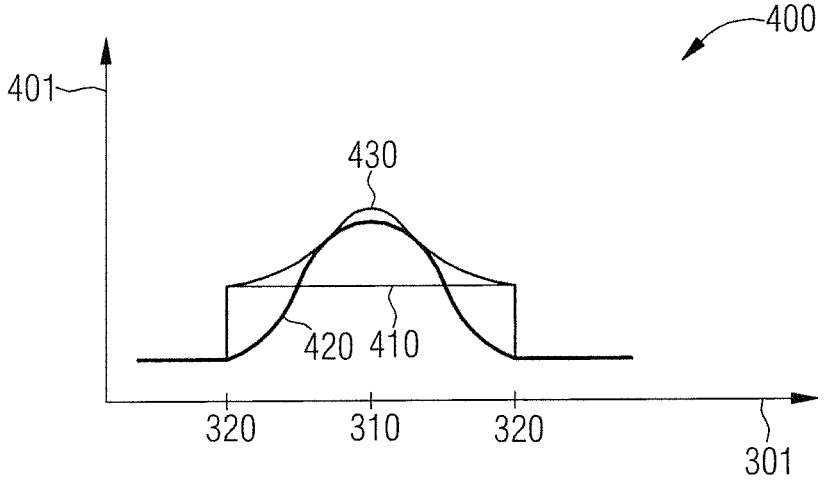
FIG. 3 schematically shows a graph to illustrate the intensity distribution of light radiated by the light source array.

FIG. 3 shows a schematic depiction of an intensity distribution of those portions of the light 105 mapped onto the imager matrix arrangement 300 by the optical system 200 radiated by the light emitting diode elements 110 and the LARP elements 120 of the light source array 100 at the location of the imager matrix arrangement 300. Plotted on a horizontal axis of the graph of FIG. 3 is the first direction 301 oriented parallel to the imager matrix arrangement 300. In this case, a middle 310 and edge regions 320 of the imager matrix arrangement 300 are marked. Instead of the first direction 301, the second direction 302, which is oriented at right angles to the first direction 301 and likewise parallel to the imager matrix arrangement 300, could also be depicted, without this changing the quality of the depicted intensity distribution. Plotted on a vertical axis of the graph of FIG. 3 is an intensity 401 of the light 105 impinging on the imager matrix arrangement 300.

A first intensity curve 410 schematically reproduces the intensity of that portion of the light 105 radiated by an exemplary selected light emitting diode element 110 of the light source array 100. The intensity of that portion of the light 105 radiated by this light emitting diode element 110 is substantially constant over the entire surface area of the imager matrix arrangement 300. Those portions of the light 105 radiated by the other light emitting diode elements 110 of the light source array 100 have a corresponding intensity distribution.

A second intensity curve 420 exemplarily reproduces the profile of the intensity of that portion of the light 105 radiated by an exemplarily selected LARP element 120 of the light source array 100 at the location of the imager matrix arrangement 300. The light radiated by this LARP element 120 has a higher intensity in the middle 310 of the imager matrix arrangement 300 than in the edge regions 320 of the imager matrix arrangement 300. The light radiated by this LARP element 120 can comprise approximately the shape of a Gaussian distribution, for example. Those portions of the light 105 radiated by the other LARP elements 120 of the light source array 100 comprise corresponding intensity distributions at the location of the imager matrix arrangement 300.

Those portions of the light 105 radiated by the individual light emitting diode elements 110 and the individual LARP elements 120 of the light source array 100 overlap at the location of the imager matrix arrangement 300. The overlap comprises a total intensity 430, shown schematically in FIG. 3, that is higher in the middle 310 of the imager matrix arrangement 300 than in the edge regions 320 of the imager matrix arrangement 300. The light emitting diode elements 110 of the light source array 100 thus produce a homogeneous background to the light 105, the intensity of which is substantially constant over the surface area of the imager matrix arrangement 300. The LARP elements 120 of the light source array 100 furthermore produce an intensity or illuminance maximum in the middle 310 of the imager matrix arrangement 300.

Figure 4:
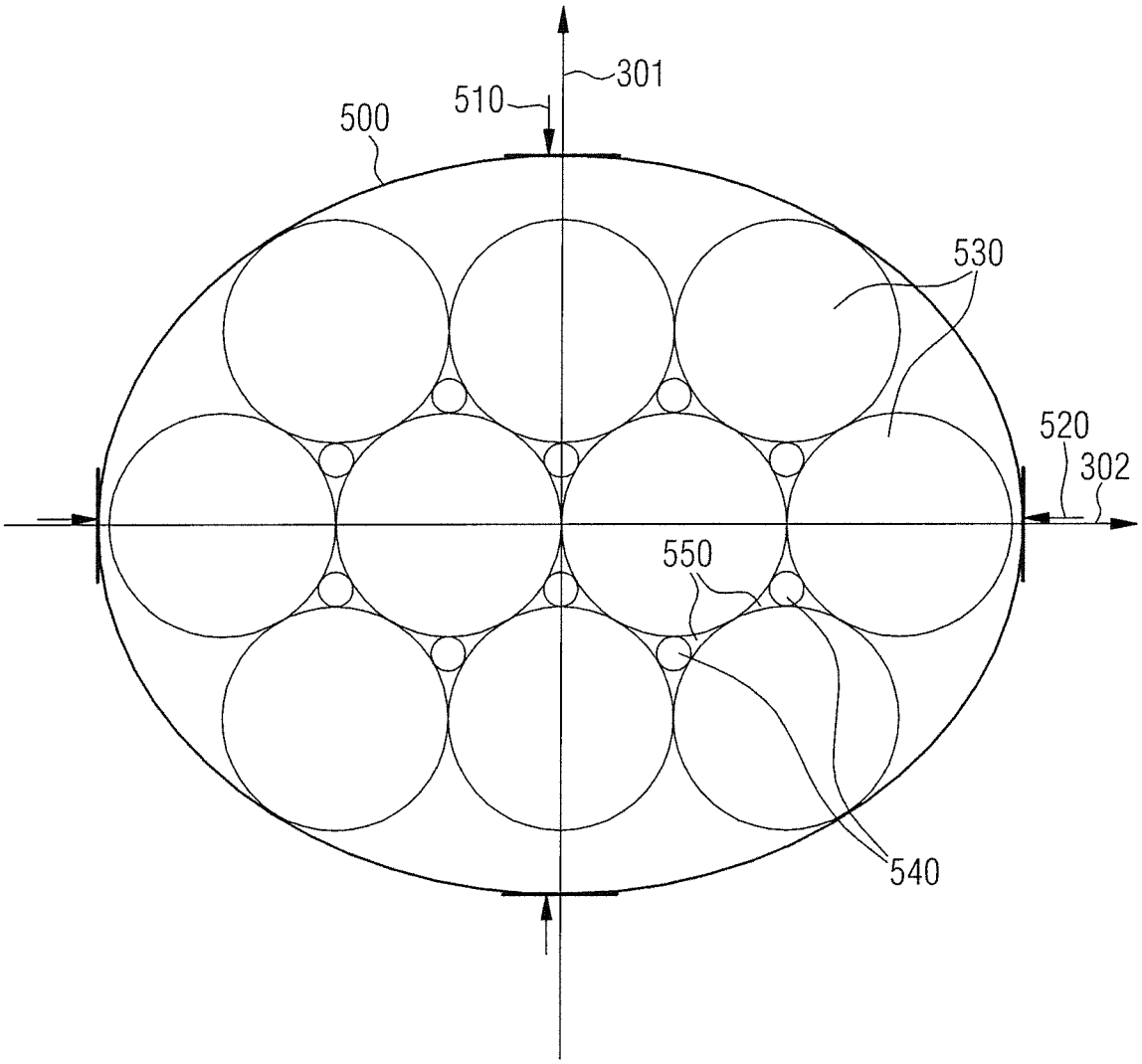
FIG. 4 schematically shows a graph to explain the angular aperture of the light mapped onto the imager matrix arrangement by the optical system.

Those portions of the light 105 radiated by the light emitting diode elements 110 and the LARP elements 120 and mapped onto the imager matrix arrangement 300 by the optical system 200 impinge on the imager matrix arrangement 300 from different angular directions. FIG. 4 shows a schematic depiction of an angular aperture 500 of the imager matrix arrangement 300. The angular aperture 500 indicates a solid angle within which the light 105 must impinge on the imager matrix arrangement 300 to be able to be controlled by the imager matrix arrangement 300. The optical system 200 is configured to map the light 105 radiated by the light source array 100 onto the imager matrix arrangement 300 with the angular aperture 500.

The angular aperture 500 has a first extent 510 of the angular aperture in the first direction 301 and a second extent 520 of the angular aperture in the second direction 302. The first extent 510 of the angular aperture and the second extent 520 of the angular aperture can have different magnitudes. In the example depicted, the second extent 520 of the angular aperture is greater than the first extent 510 of the angular aperture. The first extent 510 of the angular aperture could also be greater than the second extent 520 of the angular aperture, however. By way of example, the first extent 510 of the angular aperture can cover an angle of ±12° and the second extent 520 of the angular aperture can cover an angle of ±21°. The first extent 510 of the angular aperture and the second extent 520 of the angular aperture may also be of the same magnitude.

If the imager matrix arrangement 300 is configured as a micromirror matrix arrangement, the first direction 301 may be consistent with a direction of tilt of the micromirrors of the imager matrix arrangement 300, for example, while the second direction 302 is oriented orthogonally with respect to the direction of tilt of the micromirrors of the imager matrix arrangement 300. The first extent 510 of the angular aperture is then associated with the angle that can be modulated by tilting the micromirrors of the imager matrix arrangement 300. It is also conversely be possible for the second direction 302 to be consistent with the direction of tilt of the micromirrors of the imager matrix arrangement 300, however.

Those portions of the light 105 radiated by the light emitting diode elements 110 and the LARP elements 120 mapped onto the imager matrix arrangement 300 by the optical system 200 within the angular aperture 500. In FIG. 4, the angles 530 of the angular aperture 500 covered by the light emitting diode elements 110 and the angles 540 of the angular aperture 500 covered by the LARP elements 120 are depicted schematically. In this case, those portions of the light 105 radiated by the LARP elements 120 are mapped onto the imager matrix arrangement 300 by the optical system 200 in the depicted example such that the angles 540 covered by the LARP elements are situated in gaps 550 between the angles 530 covered by the light emitting diode elements 110. This achieves more complete coverage of the angular aperture 500 of the imager matrix arrangement 300. It is also possible for those portions of the light 150 emitted by the LARP elements 120 to be mapped onto the imager matrix arrangement 300 by the optical system 200 such that individual or multiple angles 530 of the angular aperture 500 covered by light emitting diode elements 110 are additionally also covered by one or more LARP elements 120, however.

Our light sources have been illustrated and described in more detail on the basis of preferred examples. Nevertheless, this disclosure is not limited to the examples disclosed. Rather, other variations can be derived therefrom by those skilled in the art without departing from the scope of protection of the appended claims.

This application claims priority of DE 10 2016 103 717.6, the subject matter of which is incorporated herein by reference.

The invention claimed is:

1. A pixel light source comprising:

a light source array, an optical system and an imager matrix arrangement, wherein the optical system maps light radiated by the light source array onto the imager matrix arrangement, the light source array comprises a plurality of light emitting diode elements and a plurality of LARP elements, and the optical system is configured to map the light radiated by at least one of the LARP elements into a gap in the angular aperture situated between the light radiated by the light emitting diode elements.

2. The pixel light source according to claim 1, wherein the LARP elements are arranged between the light emitting diode elements.

3. The pixel light source according to claim 1, wherein the light emitting diode elements are arranged in a hexagonal pattern.

4. The pixel light source according to claim 1, wherein the LARP elements are arranged in a hexagonal pattern.

5. The pixel light source according to claim 1, wherein the LARP elements are arranged between the light emitting diode elements, the light emitting diode elements are arranged in a hexagonal pattern, the LARP elements are arranged in a hexagonal pattern, and the hexagonal pattern of the light emitting diode elements and the hexagonal pattern of the LARP elements overlap.

6. The pixel light source according to claim 1, wherein the optical system maps the light radiated by the light source array onto the imager matrix arrangement with a first extent, measured in a first direction, of the angular aperture and a second extent, measured in a second direction, of the angular aperture, the first direction and the second direction are oriented at right angles to one another, and the first extent of the angular aperture and the second extent of the angular aperture are of different magnitude.

7. The pixel light source according to claim 1, wherein at least one LARP element is configured such that light radiated by the LARP element and mapped onto the imager matrix arrangement by the optical system comprises an intensity that falls from a middle of the imager matrix arrangement to an edge region of the imager matrix arrangement.

8. The pixel light source according to claim 1, wherein the optical system comprises a plurality of optical lenses.

9. The pixel light source according to claim 1, wherein the optical system comprises a field lens.

10. The pixel light source according to claim 1, wherein the imager matrix arrangement is configured as a micromirror matrix arrangement.

11. A headlamp for a motor vehicle comprising the pixel light source according to claim 1.

* * * * *